US005183266A

United States Patent [19]

Kohler

[11] Patent Number: 5,183,266

[45] Date of Patent: Feb. 2, 1993

[54] BASEBALL BOARD GAME

[76] Inventor: Michael Kohler, 137 Young Cir., Coopersburg, Pa. 18036

[21] Appl. No.: 814,264

[22] Filed: Dec. 23, 1991

Related U.S. Application Data

[63] Continuation of Ser. No. 547,478, Jul. 2, 1990, abandoned.

[51] Int. Cl.[5] ..... A63F 7/20

[52] U.S. Cl. ..... 273/88; 273/90; 273/129 K

[58] Field of Search ..... 273/88-93 R, 273/85 R, 123 R, 127 B, 108, 113, 114, 115, 116, 117, 118 R, 119 R, 129 K, 353, 93 C

[56] References Cited

U.S. PATENT DOCUMENTS

| | | | |
|---|---|---|---|
| D. 25,900 | 8/1896 | Redheffer | D21/18 |
| D. 84,465 | 6/1931 | Coibion | D21/18 |
| 819,212 | 5/1906 | Filer | 273/88 |
| 968,366 | 8/1910 | Krug | 273/88 |
| 1,029,448 | 6/1912 | Jessop | 273/88 |
| 1,053,568 | 2/1913 | Burch et al. | 273/89 |
| 1,106,530 | 8/1914 | Wilson | 273/88 |
| 1,114,608 | 10/1914 | Hanley | 273/353 |
| 1,235,119 | 7/1917 | Day | 273/89 |
| 1,290,726 | 1/1919 | Duggan | 273/115 |
| 1,296,882 | 3/1919 | Vance | 273/89 |
| 1,518,967 | 12/1924 | Dickinson | 273/88 |
| 1,772,116 | 8/1930 | Snodgrass | 273/89 |
| 2,053,754 | 9/1936 | Whitehall | 273/91 |
| 2,146,636 | 2/1939 | Lipchow | 273/88 |
| 2,237,351 | 4/1941 | Johnson | 273/90 |
| 2,434,195 | 1/1948 | Cantor | 273/88 |
| 2,448,837 | 9/1948 | Siberts | 273/90 |
| 2,482,083 | 9/1949 | Whitehall | 273/90 |
| 2,488,919 | 11/1949 | Mansfield | 273/90 |
| 2,596,439 | 5/1952 | Rose | 273/88 |
| 2,672,343 | 3/1954 | Augier | 273/90 |
| 2,980,427 | 4/1961 | Cragg | 273/90 |
| 3,227,452 | 1/1966 | Murphy | 273/90 |
| 3,355,173 | 11/1967 | Selker | 273/89 |
| 3,428,317 | 2/1969 | Pulgifer | 273/88 |
| 3,814,425 | 6/1974 | Kanefield et al. | 273/89 |
| 4,653,755 | 3/1987 | Panella et al. | 273/93 R |
| 4,715,603 | 12/1987 | Gleason | 273/90 |
| 4,948,135 | 8/1990 | Follety | 273/90 |

*Primary Examiner*—V. Millin
*Assistant Examiner*—Sebastiano Passaniti
*Attorney, Agent, or Firm*—Cooper & Dunham

[57] ABSTRACT

A baseball board game which utilizes scoring holes of varying sizes which are placed in such a manner as to approximate a real baseball game by the frequency of plays and events which occur in a real ball game.

5 Claims, 3 Drawing Sheets

BASEBALL BOARD GAME

This is a continuation of application Ser. No. 07/547,478, filed Jul. 2, 1990 now abandoned.

BACKGROUND OF THE INVENTION

The present invention relates to a new and useful improvement in board games. More specifically, the present invention relates to a baseball board game.

The game of baseball long has been a national pastime in the United States and, more recently, of many other nations as well. Individuals of all ages have a passion for baseball. While the real game of baseball is played outdoors and requires special equipment, the excitement of a baseball game can also be enjoyed by playing baseball board games.

Baseball board games are known. In an actual baseball game, certain events, or plays, occur more frequently than others. For example, a grand slam home run occurs less frequently than a foul ball. Baseball board games of the prior art most commonly involve the use of randomly spaced holes, in which a player attempts to direct a ball or marble, to obtain scores, or plays. Other games utilize random selection means, such as die, to determine the score or play obtained by each player. Additionally, many such games utilize a batting device which propels a ball or marble and does not require any skill or dexterity on the part of a player.

Rose U.S. Pat. No. 2,596,439 discloses a baseball game wherein a metal ball is dropped on an inclined surface and propelled out toward the playing board, which is also an inclined surface. The gameboard has several holes and channels which are assigned various values, however, Rose does not disclose arrangement of the holes in such a way as to simulate a regulation baseball game.

Siberts U.S. Pat. No. 2,448,837 also discloses a baseball game comprising a batting device which allows a ball to be propelled over the game board. The board is covered with various recesses, some of which have upstanding walls around them, to facilitate trapping the ball. The ball is rolled down a covered chute, located in the infield of the playing board, toward the batting device. Although the Siberts game involves the use of holes or recesses in which a ball or other object can become trapped and which are assigned various events or types of plays, it does not involve the use of holes which are designed to represent the occurrence and frequency of various plays and events in a baseball game.

Johnson U.S. Pat. No. 2,237,351 discloses a baseball game comprising a rotatable batting mechanism from which a ball is hit with a bat, a game board which has vertical ball catching elements located at the base positions and holes along the outer edges of the board which indicate the value to be given a batted ball which rolls into a particular hole. The ball of Johnson is struck by a batting device, not rolled to a player and batted back. Moreover, the holes are disposed along the outside edge of the board and not positioned to simulate the occurrence and frequency of various plays and events in a baseball game.

Pulcifer U.S. Pat. No. 3,428,317 also discloses a baseball game. In the Pulcifer apparatus, die are used to determine the character of a pitch, and cue sticks are used to move a disc around the game board which has several depressions to indicate first, second and third bases. There is no ball used with the Pulcifer device, thus there are no ball-catching holes positioned to simulate the occurrence and frequency of various plays and events in a baseball game.

Whitehall U.S. Pat. No. 2,482,083 also employs the use of various apertures denoting values. As the board of the Whitehall game is adaptable to various games, including baseball, football, tennis and golf, the apertures are not positioned to simulate the occurrence and frequency of various plays and events in a baseball game. Moreover, the board, when used, is positioned at an incline so that batted or hit balls will roll backward toward an aperture of a defined value. Thus, the skill required by the Whitehall device to bat or roll a ball into a desirable aperture is unusual.

The baseball board game of the present invention simulates the play and excitement of a real baseball game. In contrast to those games with mechanical batting devices or devices which use die to advance runners, the instant invention contains real game elements. A ball or marble is pitched by one player and hit by another player with a bat. The uncertain course of a batted ball creates anticipation and excitement, and results are similar to those which can be achieved in a real baseball game. The game also incorporates many of the technical rules of the game of baseball and can be enjoyed by those familiar with the rules of baseball and also can provide a means of teaching those rules to individuals less familiar with the rules of baseball.

SUMMARY OF THE INVENTION

An important object of the present invention is to provide a board game which enables users to play a game which closely simulates the actual playing of a game of baseball, on a game board and in a much shorter period of time.

A further object of the invention is to provide a simple and sturdy game device which is attractive in appearance and easy to use.

A further object of the invention is to provide a baseball game which is played with a miniature bat and which develops manual dexterity and coordination.

A further object of the invention is to provide a game which can be played with baseball cards.

The present invention is an improvement on the prior art, and discloses a baseball board game which, when played, simulates an actual baseball game.

Generally, the present invention discloses a game board having a vertical wall mounted along at least one edge of the game board and perpendicular to the game board. An outfield, infield and foul territory are defined on the game board.

A plurality of holes spans the game board and the vertical wall. Each hole is assigned a "value" of a particular play or event which can occur in a baseball game. The holes are arranged in such a manner as to simulate the frequency and occurrence with which such plays and events actually occur in a real ball game. The frequency of minor events, such as balls, strikes and foul balls are purposefully reduced to allow the game to be completed in a much shorter time frame than is a real game.

The game is played with a marble and a miniature bat, the use of which can improve coordination and dexterity of the user. A player attempts to strike a rolled marble, utilizing the bat, into a hole assigned a desirable value.

DETAILED DESCRIPTION OF THE INVENTION

The present invention contemplates a baseball board game which simulates a real baseball game and which increases the skill and manual dexterity of the user.

Figure 2:
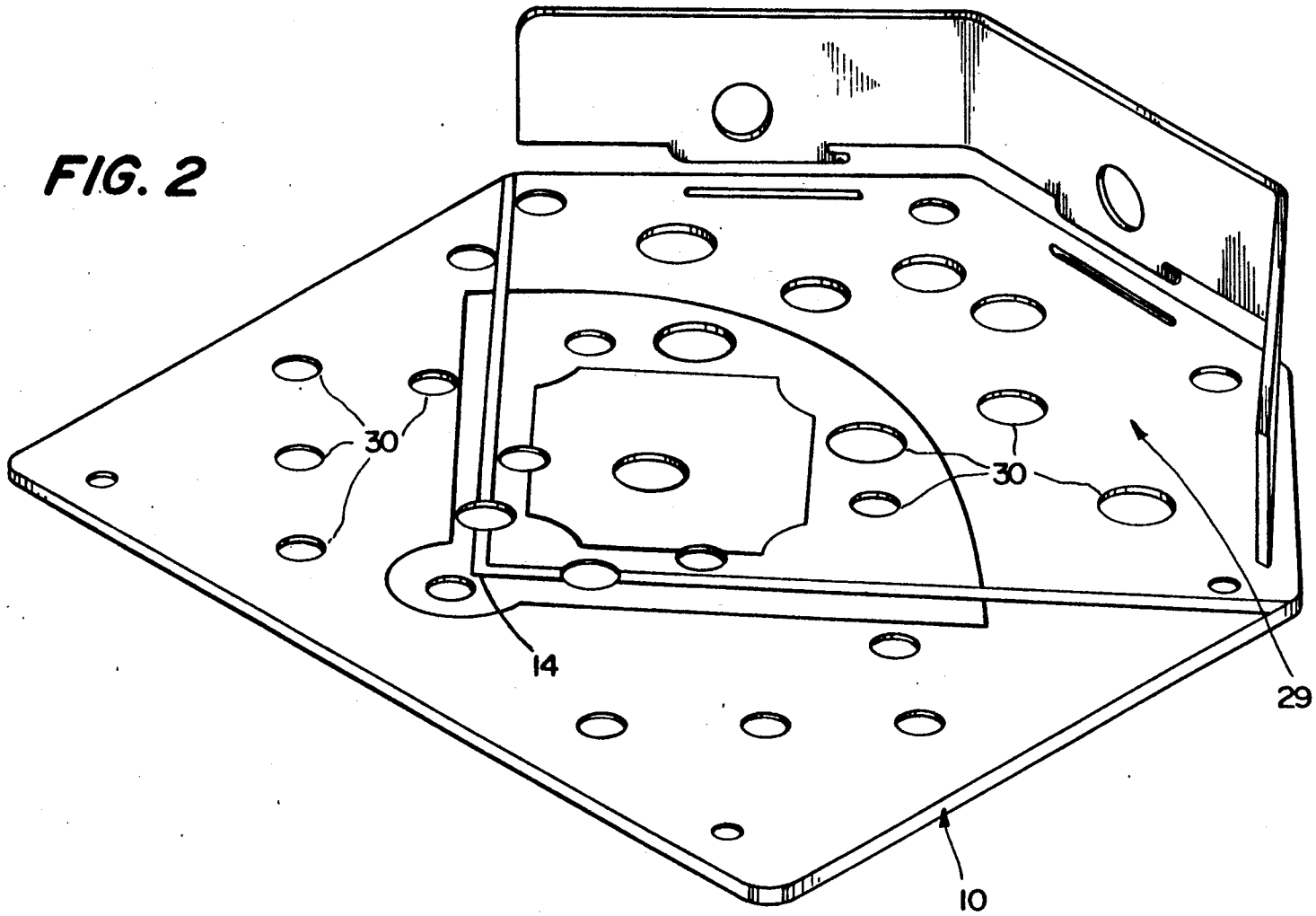
FIG. 2 is a front elevational view of the board game of the present invention.
Figure 3:
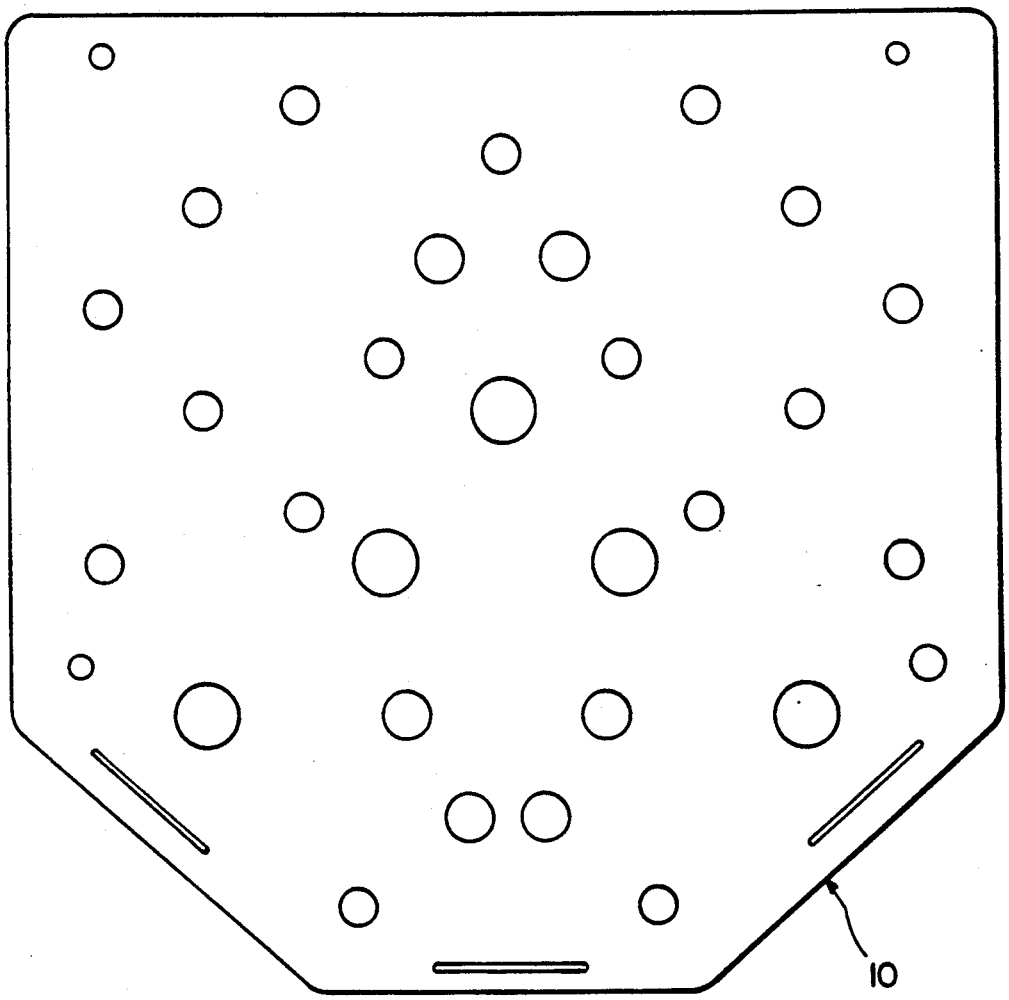
FIG. 3 is a bottom view of the board game of the present invention.

As best seen in FIG. 2, the baseball board game 5 comprises a game board 10 with a vertical wall 12 movably fixed to said game board 10 via tabs 14 affixed to one edge of vertical wall 12. As best seen in FIG. 2, tabs 14 are inserted into notches 17. The entire vertical wall 12 is then engaged in such a manner as to cause lips 19 located on tabs 14 to lock onto the underside of game board 10, thereby fastening vertical wall 12 to game board 10. This connection provides a firm fit which requires no glue or fasteners and which provides easy removal of said vertical wall 12 for travel and storage. Vertical wall 12 simulates an outfield wall found in baseball stadiums.

In one embodiment, game board 10 is made of plastic and is covered with a textured playing surface which prevents a ball or marble in play from easily sliding across game board 10 and which causes said ball or marble to lurch unexpectedly as it rolls across gameboard 10 creating excitement in the play of the game. Alternatively, game board 10 may be made of cardboard or other suitable material. The game board 10 has drawn upon it a baseball field 13 comprising an infield 28, outfield 29, and foul lines 22 and 24. The infield 28 and outfield 29 define a playing area on the playing surface.

Figure 1:
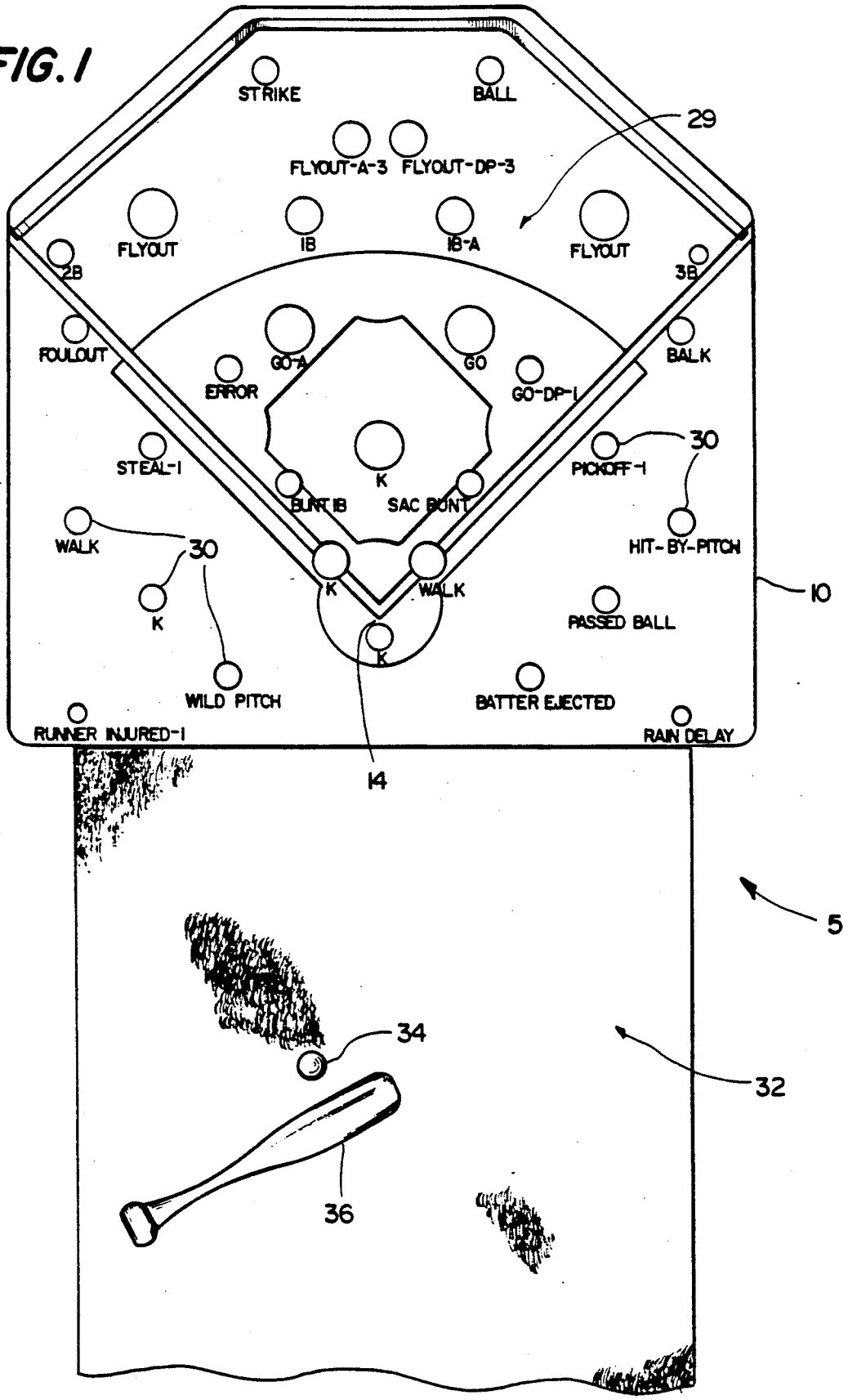
FIG. 1 is a top plan view of the board game of the present invention.

Pitcher's mound 26 is in the center of infield 28 and is defined by a hole cut into game board 10. Several other holes 30 are cut into game board 10 and vertical wall 12 and spaced about the playing surface and the vertical wall. Each hole 30 is assigned a value, or event, such as "wild pitch" or "rain delay". The holes 30 are arranged upon game board 10 in such a manner as to simulate the frequency and occurrence with which such events occur in a real ball game. The sizes of the holes vary. Those holes which define more common plays are larger than those holes which define less common plays, thus, it is easier for a batted ball, or marble, to roll into a larger hole. For example, the hole assigned the value equivalent to a single, which would permit a batter to reach first base, is not located at the first base position on game board 10, but rather is located in outfield 29 at a point on game board 10 which, because of its size and placement, more accurately simulates the frequency with which a single is obtained in a real baseball game. Holes 30 which are cut into vertical wall 12 are valued as home runs. Relative sizes of the holes 30 in one embodiment of the invention are shown in FIG. 1. In one embodiment, game board 10 is not thicker than about ⅛ inch, in order to facilitate removal of a ball or marble in play from holes 30.

In use of the baseball board game 5, as best seen in FIG. 1, batting rug 32 is placed in front of game board 10. A batter assumes a position behind batting rug 32. A pitcher rolls marble 34 along batting rug 32 and toward the first player. Alternatively, a player who wishes to play the game by his or her self to test or improve skills can roll marble 34 with the non-batting hand. The batter attempts to hit marble 34 with bat 36 into a hole with a desirable value. Strength used to propel marble 34 will vary according to the size and placement of the specific hole 30 the batter wishes to reach.

In one embodiment of the invention, the various holes 30 have been assigned the following values and results:

| HOLE NAME | BATTER RESULT | RUNNERS RESULT |
|---|---|---|
| 1B | ADVANCES TO FIRST | ADVANCE 1 BASE |
| 1B-A | ADVANCES TO FIRST | ADVANCE 2 BASES |
| 2B | ADVANCES TO SECOND | ADVANCE 2 BASES |
| 3B | ADVANCES TO THIRD | ADVANCE 3 BASES |
| BALK | BATS AGAIN | ADVANCE 1 BASE |
| BATTER EJECTED | BATTER REPLACED | STAY |
| BUNT 1B | ADVANCE TO FIRST | ADVANCE 1 BASE |
| ERROR | ADVANCES TO FIRST | ADVANCE 1 BASE |
| FOULOUT | OUT | STAY |
| FLYOUT | OUT | STAY |
| FLYOUT-A-3 | OUT | RUNNER ON THIRD SCORES, OTHERS STAY |
| FLYOUT-DP-3 | OUT | RUNNER ON 3RD OUT TRYING TO SCORE, OTHERS STAY |
| GO | GROUNDOUT | STAY |
| GO-A | GROUNDOUT | ADVANCE 1 BASE |
| GO-DP-1 | GROUNDOUT | DOUBLE PLAY IF RUNNER ON FIRST, OTHERS STAY |
| HIT-BY-PITCH | ADVANCES TO FIRST | ADVANCE 1 BASE IF FORCED |
| K | STRIKEOUT | STAY |
| HOME RUN | SCORES A RUN | SCORES RUN |
| PASSED BALL | TAKES A "BALL" | ADVANCE 1 BASE |
| PICKOFF-1 | BATS AGAIN | OUT IF ON 1ST OTHERS STAY |
| RAIN DELAY | WAITS FIVE MINUTES FOR PLAY TO RESUME | STAY |
| RUNNER INJURED | BATS AGAIN | INJURED RUNNER ON 1ST REPLACED OTHERS STAY |
| SAC BUNT | OUT | ADVANCE 1 BASE |
| STEAL-1 | BATS AGAIN | RUNNER ON FIRST ADVANCE ONE BASE OTHERS STAY |
| WALK | ADVANCE TO FIRST | ADVANCE 1 BASE IF FORCED |
| WILD PITCH | TAKE A "BALL" | ADVANCE 1 BASE |

It is assumed that one reading the above description is familiar with the way baseball is played and the rules of the game, which are incorporated by reference herein.

Baseball cards or other markers can be used to mark the positions of runners on game board 10 and to keep track of scores.

As might be expected, the player with the highest score wins the game.

Various modification may be made in the game board 10 without departing from the spirit and scope of the invention.

I claim:

1. A baseball board game, comprising a game board defining a substantially flat, horizontally arranged playing surface, means for defining a representation of an infield, an outfield and foul territory upon said playing surface of said game board, a vertically disposed wall secured to said playing surface proximate to an outer edge of said playing surface, a plurality of holes of different sizes arranged about and in said playing surface and said wall, a textured batting surface positioned adjacent to an open edge of said playing surface opposite said outer edge and substantially in the same plane as said playing surface;

a ball unattached to said playing surface and said batting surface; and a bat unattached to said playing surface and said batting surface and usable to strike said ball;

said holes being adapted to receive a batted ball and being selectively designated to define fly-outs, strikes, balks, balls, walks, steals, foul-outs, errors, bunts, strike-outs, wild pitches, ejected batters, rain delays, injured runners, ground-outs, hits by pitch, pick-offs, passed balls and single, double and triple base hits; said holes defining said single base hit being located in said means representing said outfield and said holes defining said double and said triple base hits being located adjacent a boundary between said means representing said outfield and said means representing said foul territory means for defining a representation of an infield, an outfield and foul territory upon said playing surface of said game board, said holes defining said single base hit being located in said means representing said outfield and said holes defining said double and said triple hits being located adjacent a boundary between said means representing said outfield and said means representing said foul territory.

2. A baseball board game, according to claim 1 wherein said holes in said wall define at least one home-run and said holes in said playing surface define at least one strike-out, one fly-out, one strike, one balk, one ball, one walk, one steal, one foul-out, one error, one bunt, one wild pitch, one ejected batter, one rain delay, one injured runner, one groundout, one hit by pitch, one pick-off, one passed ball and one base hit.

3. A baseball board game, comprising, a game board defining a substantially flat, horizontally arranged playing surface, means for defining a representation of an infield, an outfield and foul territory upon said playing surface of said game board, a vertically disposed wall secured to said playing surface proximate to a first edge of said playing surface, a plurality of holes of different sizes arranged about and in said playing surface and said wall and being selectively designated to define fly-outs, strikes, balks, balls, walks, steals, foul-outs, errors, bunts, strike-outs, wild pitches, ejected batters, rain delays, injured runners, ground-outs, hits by pitch, pick-offs, passed balls and single, double and triple base hits; said holes defining said single base hit being located in said means representing said outfield and said holes defining said double and said triple hits being located adjacent a boundary between said means representing said outfield and said means representing said foul territory;

a textured batting surface positioned adjacent to a second edge of said playing surface opposite said first edge and substantially in the same plane as said playing surface;

a bat unattached to said playing surface and said batting surface and which is adapted to be swung by a first game player; and a ball unattached to said playing surface and said batting surface and which is adapted to be propelled across said batting surface by a second game player;

whereby when said second game player propels said ball along said batting surface and said first game player swings said bat to strike said ball, said ball is caused to be propelled onto said playing surface and toward and into one of said holes to simulate the probability of occurrence of respective baseball plays and events during an actual baseball game.

4. A baseball board game, according to claim 3, wherein the functions of said first and said second game players are performed by the same individual.

5. A method of playing a simulated baseball board game, comprising the steps of:

arranging a flat horizontally arranged game board, provided with holes of different sizes adjacent to and in contact with one edge of a horizontally arranged textured batting surface wherein said holes are selectively designated to define fly-outs, strikes, balks, balls, walks, steals, foul-outs, errors, bunts, strike-outs, wild pitches, ejected batters, rain delays, injured runners, ground-outs, hits by pitch, pick-offs, passed balls and base hits; defining a representation of an infield, an outfield and foul territory upon said playing surface of said game board; locating said holes defining said single base hit in said means representing said outfield and said holes defining said double and said triple base hits adjacent a boundary between said means representing said outfield and said means representing said foul territory propelling a ball such that it rolls on the batting surface toward a bat;

striking the rolling ball on said batting surface with the bat such that the ball is propelled toward one of the holes of said game board;

recording the events defined by the hole into which the ball is propelled;

recording a strike when said ball is propelled off said game board; and recording a ball when said ball is propelled onto and remains on said game board and does not enter any of said holes, thereby stimulating the scoring of baseball plays and events during an actual baseball game.

* * * * *